US005370034A

United States Patent [19]

Turner et al.

[11] Patent Number: 5,370,034

[45] Date of Patent: Dec. 6, 1994

[54] REACTIVE ARMOR SYSTEM WITH IMPROVED FLYPLATES

[75] Inventors: James R. Turner, Campbell; Ronald E. Musante, Los Altos; T. James Dorsch, Los Gatos, all of Calif.

[73] Assignee: FMC Corporation, Chicago, Ill.

[21] Appl. No.: 85,373

[22] Filed: Jul. 2, 1993

[51] Int. Cl.[5] ..... F41H 5/04; F41H 5/013

[52] U.S. Cl. ..... 89/36.02; 89/36.08; 109/49.5

[58] Field of Search ..... 89/36.02, 36.04, 36.08, 89/36.09, 36.07, 36.12; 109/49.5, 82, 83, 84

[56] References Cited

U.S. PATENT DOCUMENTS

| | | | |
|---|---|---|---|
| 952,877 | 3/1910 | Cowper-Coles | 89/36.04 |
| 4,179,979 | 12/1979 | Cook et al. | 109/49.5 |
| 5,070,764 | 12/1991 | Shevach et al. | 89/36.04 |

FOREIGN PATENT DOCUMENTS

| | | | |
|---|---|---|---|
| 312399 | 4/1989 | European Pat. Off. | 89/36.02 |
| 503197 | 6/1920 | France | 89/36.02 |
| 2635177 | 2/1990 | France | 89/36.02 |
| 3134341 | 5/1982 | Germany | 89/36.02 |

*Primary Examiner*—Stephen M. Johnson

*Attorney, Agent, or Firm*—M. B. Lee; R. C. Kamp; R. B. Megley

[57] ABSTRACT

A method and apparatus is disclosed as a passive armor system for use on the side walls and sloping front wall of a military vehicle as reactive armor which adds the element of erosion and disruption of the flyplates thereby improves performance especially against kinetic energy threats but also by shaped charge weapons without substantially increasing the weight of the vehicle and without the aid of explosive charges.

20 Claims, 5 Drawing Sheets

REACTIVE ARMOR SYSTEM WITH IMPROVED FLYPLATES

BACKGROUND OF THE INVENTION

Field of the Invention

The present invention pertains to armor systems and more particularly relates to improved passive armor units with flyplates for use in reactive armor which adds the element of erosion and disruption of the flyplates which improves performance especially against kinetic energy threats thus minimizing threats to vehicles by destroying their ability to penetrate conventional vehicle armor. The improved flyplates increase battle field vehicle protection, especially by kinetic energy weapons, and also by shaped charge weapons without a substantial increase in weight or bulk of the armor system and without the aid of explosive charges encompassed within adjacent flyplates.

SUMMARY OF THE INVENTION

The present invention relates to a reactive armor system for defeating chemical energy and kinetic energy threats to targets including military vehicles. The reactive armor system includes a metal housing on at least the front wall and side walls of the vehicle for intercepting the weapons and at least partially defeating the weapon by using a first plurality of layers of steel flyplates inwardly of first layers of glass blocks encompassed within a urethane housing. A layer of tool wax, or alternately an air space, is inserted between the first layer of flyplates and a second layer of flyplates which layers of flyplates and glass plates defeat the chemical energy and kinetic energy threats.

DESCRIPTION OF THE PREFERRED EMBODIMENT

Figure 1:
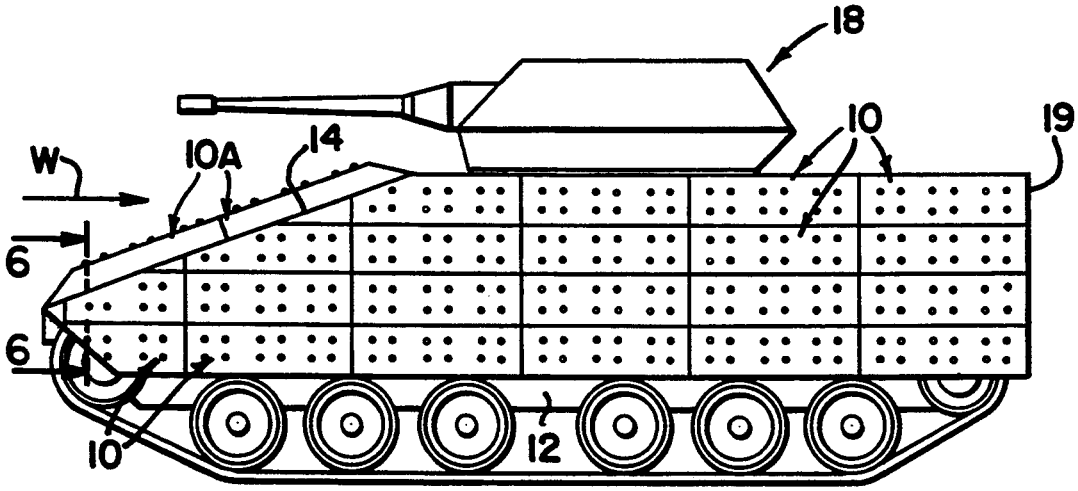
FIG. 1 is a side elevation of a military vehicle illustrating a plurality of hang-on housings on a side wall and front wall of the vehicle.

Prior to describing the details of the present invention, it is believed that the following three types of armor should be mentioned.

Passive armor uses no explosives.

Active armor seeks out incoming threats and intercepts and defeats the threat before it hits a target, such as a vehicle, by sensing the sound or other characteristic of the incoming threat.

Reactive armor reacts after being hit by a threat such as a heat round or a projectile to defeat the threat when it hits the armor on an object herein illustrated as a vehicle.

The subject application is directed to neutralizing threats only by reactive armor.

A plurality of passive armor units 10 (FIG. 1) of the present invention are illustrated as being mounted on the side wall 12, and sloping front wall 14 of a military vehicle 18 which also has at least two passive armor units 10A on the sloping front wall. Third passive armor units (not shown) may be mounted on the rear wall 19 of the military vehicle 18.

As illustrated in FIG. 1, the sloping front wall 14 receives at least two passive armor units 10A for protecting the sloping front wall 14 of the vehicle.

Figure 2:
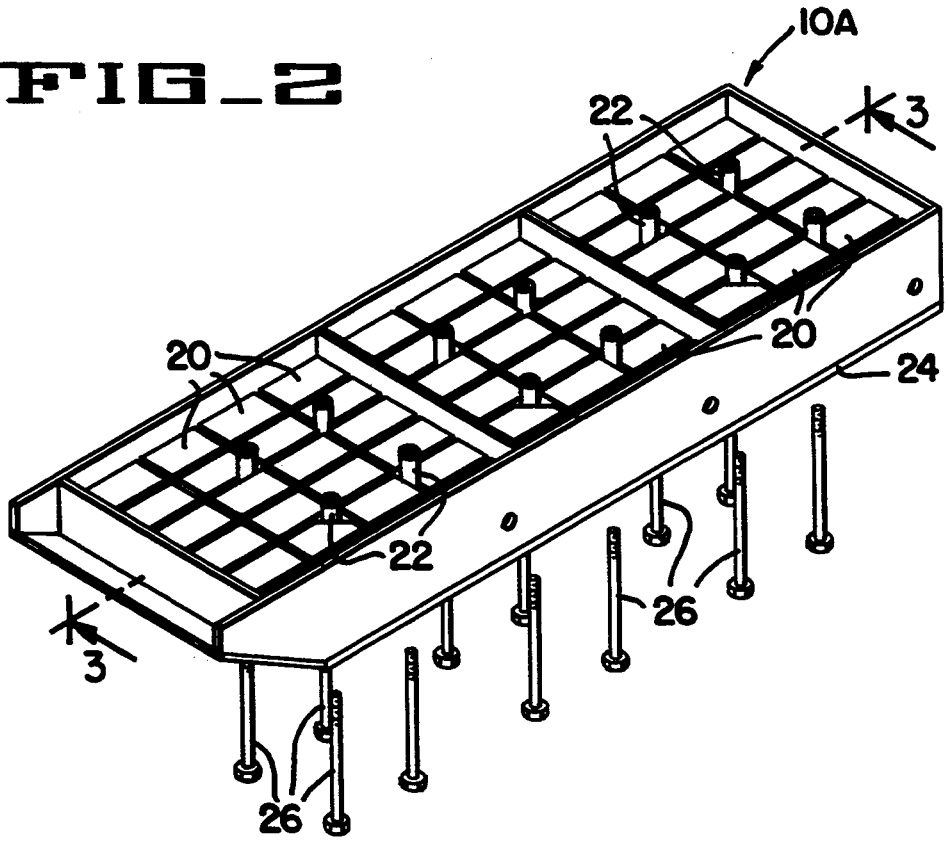
FIG. 2 illustrates an inverted front hang-on housing having a tapered front end and two inner layers of steel flyplates with elongated connecting bolts and tubes of a first embodiment of the invention for securing the housing to the vehicle.

Having reference to FIG. 2, a first embodiment of the passive armor unit 10A is illustrated in an inverted position having at least some layer of steel flyplates 20 therein and illustrating a plurality of spacer tubes 22 projecting upwardly from the upper wall 24 of the passive armor units 10A when in operative position as illustrated in FIG. 1. The tubes 22 receive long cap screws 26 (FIG. 2) that are threaded into the sloping front wall 14 of the military vehicle 18 to rigidly connect the passive armor units 10A to the sloping front wall 14 of the vehicle as illustrated in FIG. 1.

Figure 3:
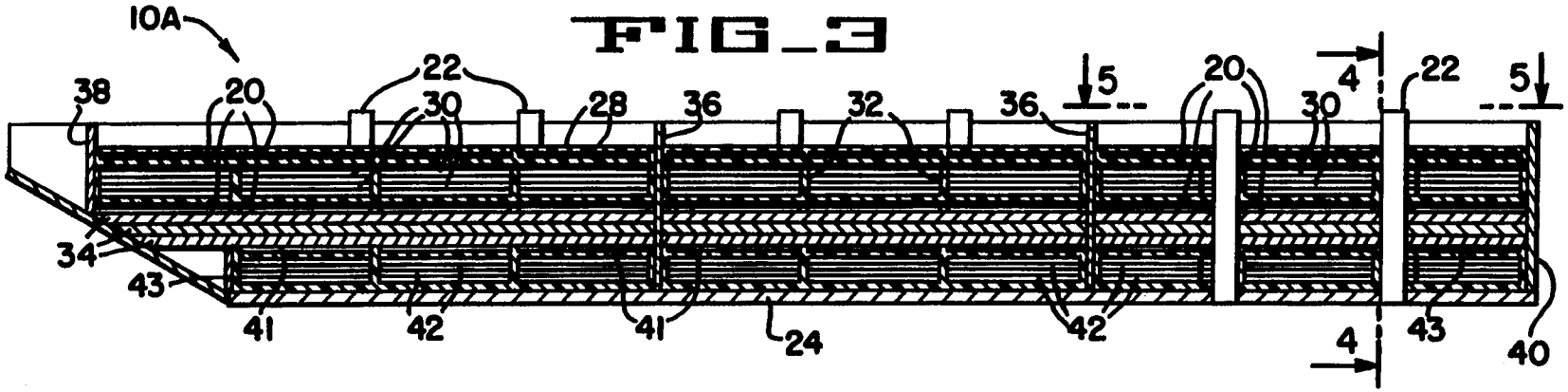
FIG. 3 is a section taken along lines 3—3 of FIG. 2 illustrating a first embodiment of the invention having first and second layers of steel flyplates imbedded in layers of urethane with said plurality of layers being separated by tool wax.

FIG. 3 is a vertical section taken at a larger scale along lines 3—3 of FIG. 2 illustrating the internal components of a first embodiment of the invention.

A plurality of the steel flyplates 20 are spaced from each other in a single layer and are encompassed within upper and lower layers 28 of urethane for firmly supporting the flyplates as shown in FIG. 3. A plurality of groups of glass blocks 30 are spaced from each other and the flyplates 20 by horizontal and vertical layers of urethane 32 which minimizes damage to adjacent groups of glass blocks 30 which are not initially hit by the weapon.

Three layers of tool wax 34 (FIG. 3) are placed within the passive armor unit 10A and are separated by baffles 36 and end walls 38 and 40 as illustrated in FIG. 3. A second group of flyplates 41 and a second group of glass blocks 42 are encompassed within a second urethane housing 43.

Figure 4:
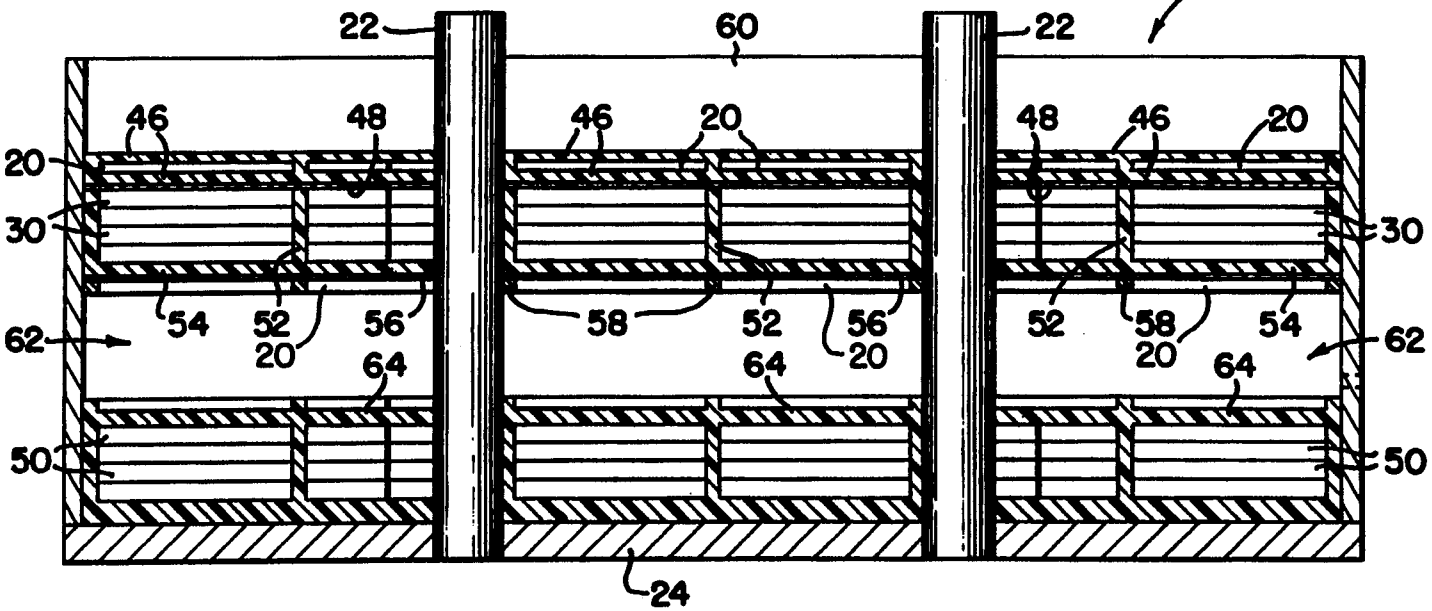
FIG. 4 is a section taken at a larger scale along lines 4—4 of FIG. 3 of a second embodiment of the invention illustrating a plurality of steel flyplates imbedded in urethane layers, and having a plurality of layers of glass blocks and a second. plurality of layers of steel plates and a plurality of layers of glass blocks embedded in a second urethane housing.

A modified second passive armor unit 10A is illustrated in FIG. 4, and includes a plurality of groups of steel flyplates 20 which are spaced a short distance from each other and are encompassed within two layers of urethane 46. A first layer of a fabric 48 sold under the trademark KEVLAR, hereinafter referred to as "Keylar fabric" (FIG. 4) is positioned between one of the urethane layers 46 and a plurality of spaced groups of glass blocks 30, which groups are separated from each other by upstanding urethane walls 52 and elongated lower urethane walls 54. The upstanding urethane walls 52 are integral with the wall 54 which seals the glass blocks 30 in associated pockets surrounded by Kevlar fabric 48 and 56. A plurality of steel supports 58 (FIG. 4) are connected to outer side walls 60 as by welding and provide support for the upper layers of groups of glass blocks 30.

As also illustrated in FIG. 4, a modified embodiment of the passive armor unit 10A differs from the FIG. 3 embodiment in that the tool wax layer 34 illustrated in FIG. 3 is replaced by an air space 62. A second urethane housing 64 encompasses a second plurality of glass blocks 50 which are separated from the first glass blocks 30 by the air space 62.

Figure 5:
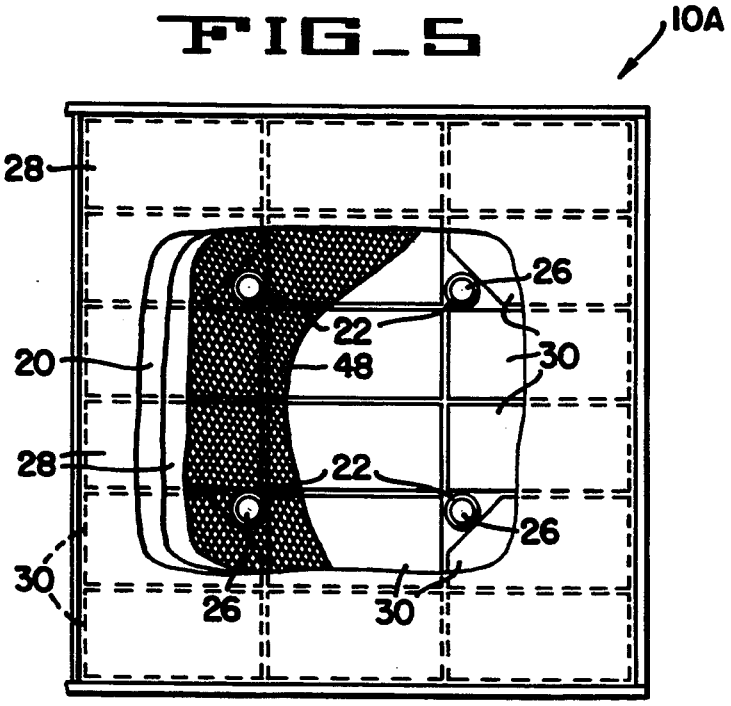
FIG. 5 is an enlarged cut away plan view of a portion of FIG. 3 taken along lines 5—5 of FIG. 3 illustrating a glass and steel encasement surrounded by a urethane elastic polymer.
Figure 6:
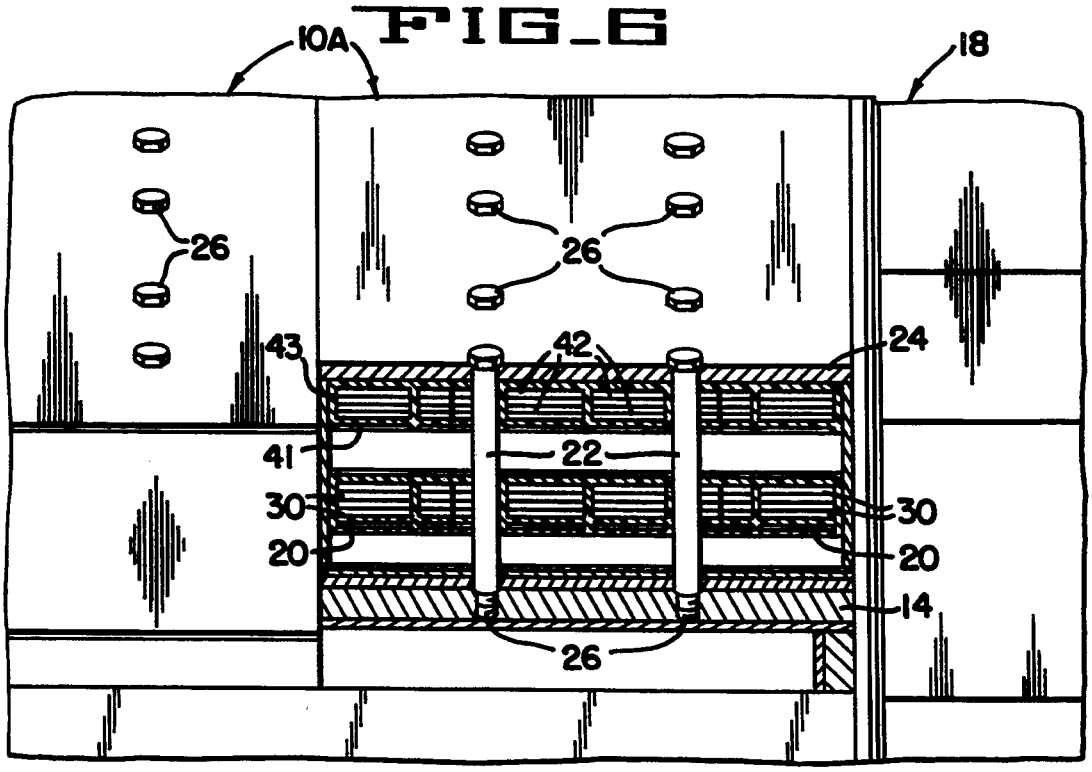
FIG. 6 is an enlarged cross-section taken along lines 6—6 of FIG. 1 illustrating a portion of the sloping front wall of the military vehicle along with means for clamping the sloping front wall to the vehicle.

FIG. 5 is a cut away plan view taken along lines 5—5 of FIG. 3 illustrating the several layers of material of a fragment of one of the passive armor units 10A attached to the sloping front walls 14 (FIG. 1) with pans being cut away, and with the passive armor unit 10A being inverted.

As indicated in FIGS. 3 and 5, upper and lower layers of urethane 28 and 32 encompasses a plurality of steel flyplates 20. Some of the flyplates have corners cut off to permit the spacer tubes 22 and elongated cap screws 26 (FIGS. 2 and 5) to clamp the passive armor unit 10 to the military vehicle 18 (FIG. 1). The Kevlar fabric 48 and the glass blocks 30 are likewise held together by the cap screws 26 (FIG. 2) and spacer tubes 22.

Figure 7:
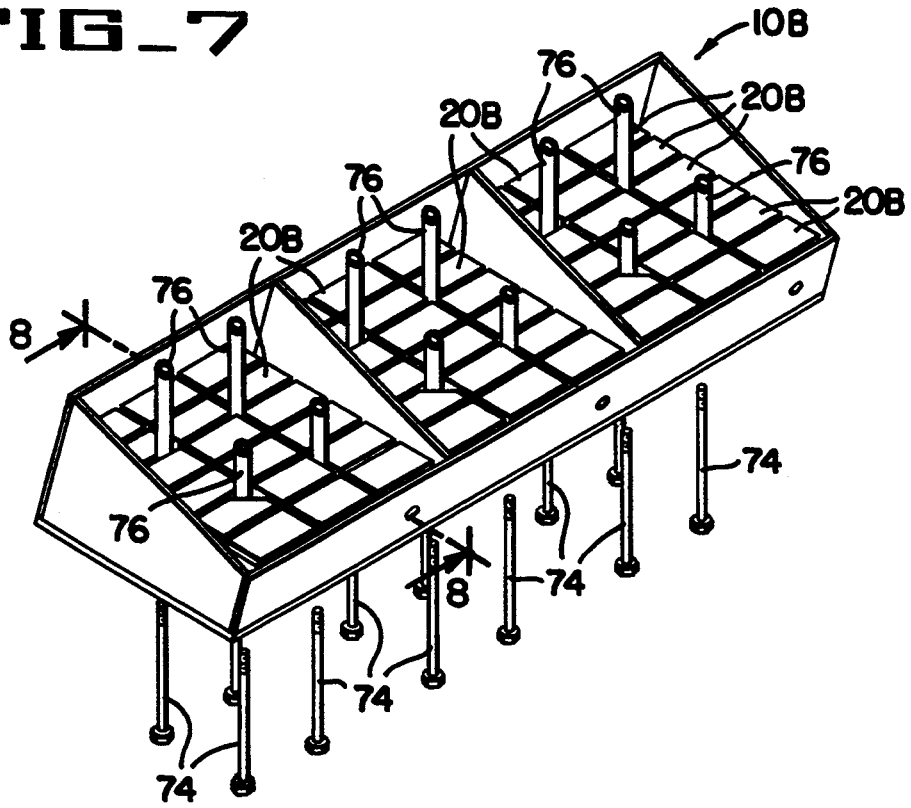
FIG. 7 is an inverted panel for use on at least the side walls of the military vehicle for intercepting weapons which are propelled horizontally at the vehicle.
Figure 8:
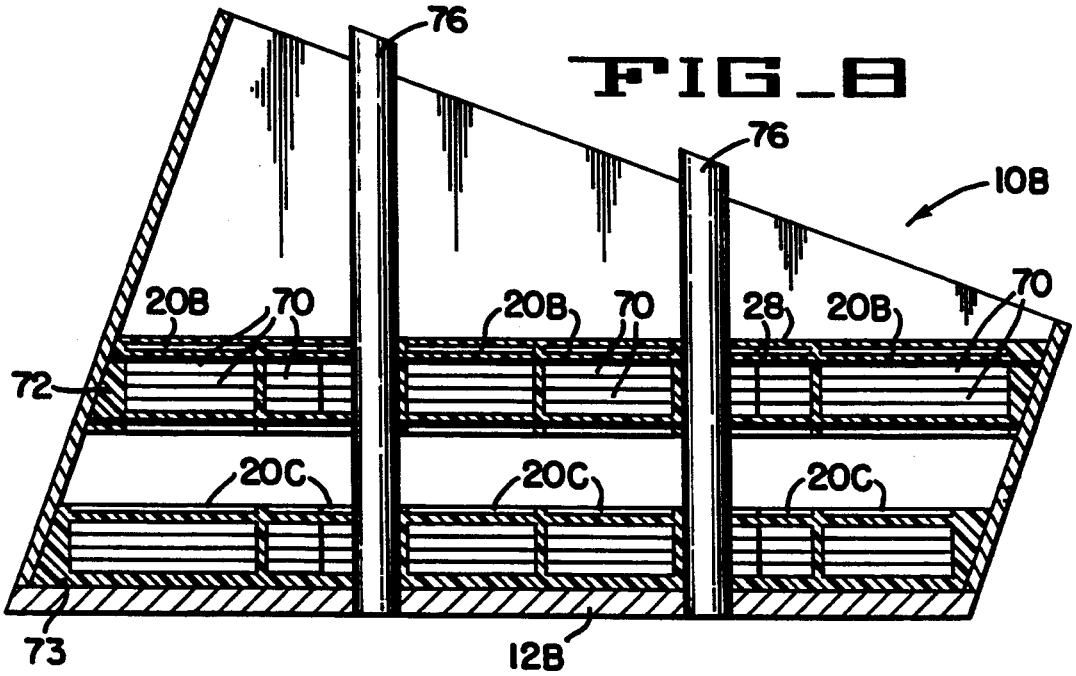
FIG. 8 is an enlarged section taken along lines 8—8 of FIG. 7.
Figure 9:
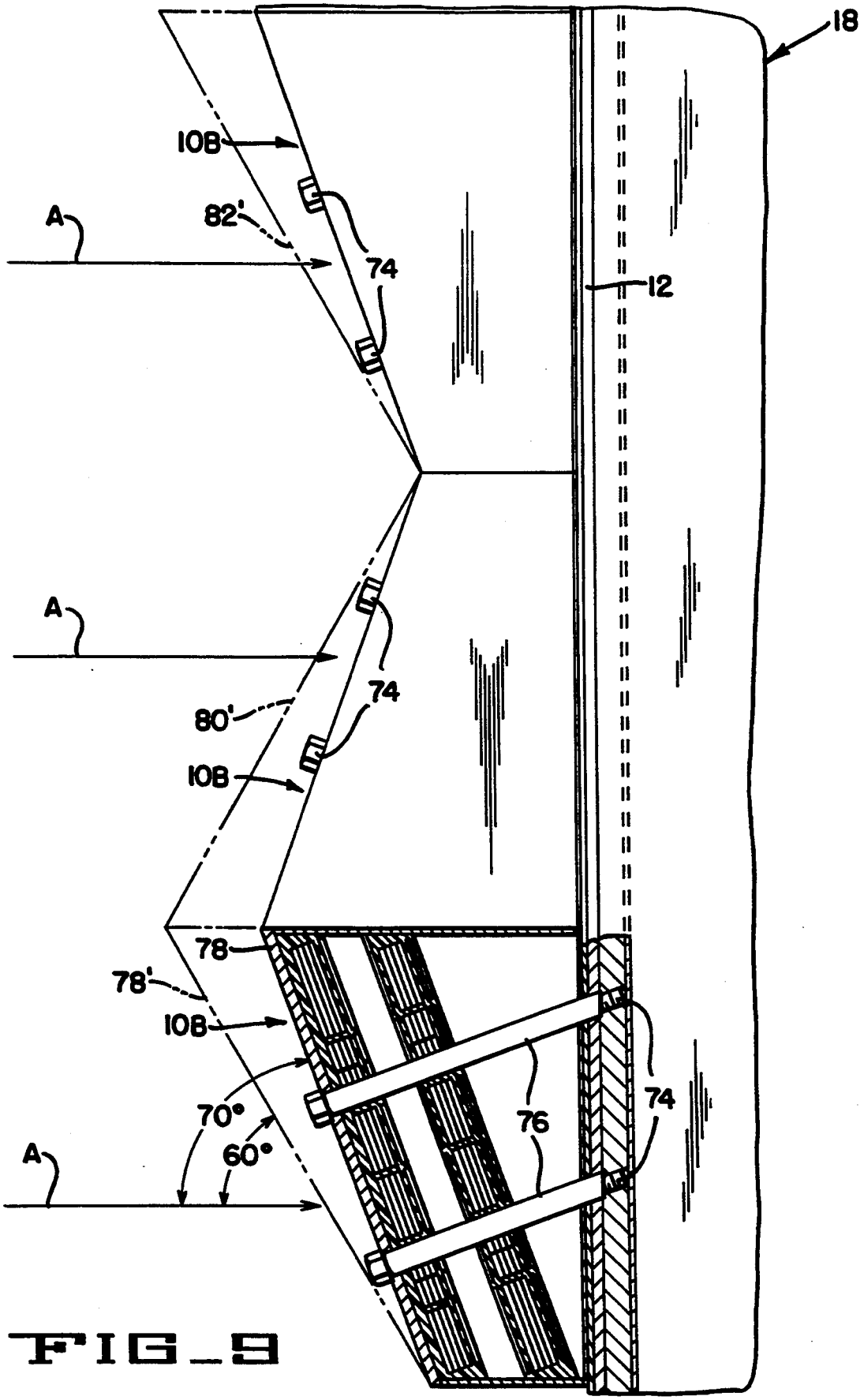
FIG. 9 illustrates a plurality of panels on one vertical side wall of the military vehicle with one of the panels being shown in section, and with the trajectory of several weapons being illustrated as horizontal.

FIGS. 7, 8 and 9 illustrate generally truncated V-shaped passive armor units 10B which are connected to the side walls 12 (FIG. 9) of the vehicle by cap screws 74 which extend through the tubes 76.

FIG. 7 illustrates the truncated V-shaped armor unit 10B which includes a plurality of flyplates 20B therein which are bolted to the side walls 12 of the military vehicle 18 (FIGS. 1 and 9).

FIG. 8 is a cross-section taken generally along 8—8 of FIG. 7 illustrating one of a plurality of passive armor units 10B with one layer of steel flyplates 20B embedded in urethane 28 and having four layers of glass blocks 70 also encompassed within a first urethane housing 72.

A second group of spaced flyplates 20C are sealed to the top of the second urethane housing 73 (FIG. 8) which housing 73 is partially supported on a vertical base **12*b* of the vehicle (FIGS. 8 and 9) by a plurality of elongated cap screws 74 (FIG. 9) of the military vehicle 18** (FIGS. 1 and 9).

Having reference to FIG. 9, a portion of a side wall 12 of the vehicle 18 is cut away with one of the passive armor units 10B being shown in vertical section. Arrows A indicate that weapons are being fired horizontally at the military vehicle and hit the vehicle's armor obliquely thereby causing the path of the weapon to be defeated resulting in more damage to the flyplates and less damage to the vehicle 18.

If higher powered weapons are anticipated, the outer walls 78 of the passive armor units 10B may be angled so that their outer surfaces lie on the phantom lines 78', 80', and 82' (FIG. 9) thus further deflecting the route of the weapon and increase the damage to the outer walls of the flyplates while minimizing damage to the military vehicle 18.

In operation of the method and apparatus of the improved armor units 10 and 10A of the present invention several modified passive armor units 10A are disclosed.

The passive armor units 10A (FIGS. 1—4) are designed for use on sloping front walls 14 of the military vehicle 18. As illustrated in FIG. 1, the arrow W indicates the usual substantially horizontal route of the weapon (FIG. 1) at a target such as the military vehicle 18 which weapon contacts the layers of flyplates at an angle of about 20° relative to the horizontal axis of the vehicle thus obliquely contacting and damaging several of the steel flyplates 20 thus more effectively protecting the body of the military vehicle 18 from extensive damage.

As indicated in FIG. 3, intermediate layers of tool wax 34 is inserted between the two layers of flyplates 20 and 41 which are bonded between layers of urethane 28.

FIG. 4 is an enlarged modified cross section taken along lines 4—4 of FIG. 3 but eliminates the tool wax layer 34, and substitutes an air space 62 between the two adjacent urethane layers 54 and 64.

As illustrated in FIG. 9, the weapon when moving horizontally in the direction of the arrows A will contact the flyplates 78 at an angle of about 70° when in the solid line position, and an angle of about 60° when in the phantom line position. Accordingly, when the steel flyplates 78 are at an angle of 60°, the flyplates will receive more damage from the weapon, and the side wall 12 of the vehicle will receive less damage from the weapon. Conversely, when the steel plates are at an angle of 70°, the flyplates will receive less damage from the weapon, and the side wall of the vehicle will receive more damage.

From the foregoing description it will be apparent that the reactive armor system of the present invention is intended for use on side walls and sloping front walls of a military vehicle as reactive armor which adds the element of erosion and disruption of the flyplates thereby improving performance, especially against kinetic energy threats but also by shaped charge weapons without substantially increasing the vehicle weight and without the aid of explosive charges.

Although the best mode contemplated for carrying out the present invention has been herein shown and described it will be understood that modification and variation may be made without departing from what is regarded to be the subject matter of the invention.

What is claimed is:

1. A reactive armor system for defeating chemical energy and kinetic energy threats to targets including military vehicles, comprising:

means defining at least one metal housing mounted on said target in position to intercept a weapon;

means defining first layers of glass blocks within said metal housing for intercepting said weapon and at last partially defeating the weapon;

means defining second layers of glass blocks within said metal housing and spaced from said first layer of glass blocks for intercepting said weapon and at least further defeating said weapons;

means defining a first plurality of steel flyplates inwardly of said first layer of glass blocks; and means defining a second plurality of steel flyplates inwardly of said second layer of glass blocks, said first and second plurality of steel flyplates when hit by a weapon being effective to defeat the weapon without permanently damaging said target.

2. An apparatus according to claim 1 wherein said first and second layers of glass blocks each including at least four layers of glass blocks.

3. An apparatus according to claim 1 wherein said first and second layers of glass blocks are spaced from each other by at least one layer of wax.

4. An apparatus according to claim 1 wherein said first and second layers of glass blocks are spaced from each other by an air space.

5. An apparatus according to claim 1 wherein said glass blocks and said steel flyplates are supported by and attached to urethane housings spaced from each other by an air space.

6. An apparatus according to claim 5 wherein three rows of spaced flyplates are attached to a lower surface of an upper urethane housing, an upper surface of a lower urethane housing, and within a lower portion of said lower urethane housing.

7. An apparatus according to claim 6 wherein said reactive armor system is connected to a front sloping wall of the military vehicle.

8. An apparatus according to claim 6 wherein said reactive armor system is connected to a side wall of the military vehicle.

9. An apparatus according to claim 7 wherein said front sloping wall of said military vehicle is made of armor and wherein said front sloping wall intercepts and defeats weapons directly horizontally at said sloping front wall thereby hitting the armor obliquely causing a path of the weapon which is deflected by the flyplates resulting in more damage to the flyplates and less damage to the vehicle.

10. An apparatus according to claim 1 and additionally comprising:

means defining a third plurality of steel flyplates spaced from each other and lying in a third placed parallel plane.

11. An apparatus according to claim 10 wherein a first space is provided between said first and second layers of glass blocks.

12. An apparatus according to claim 11 wherein said first space is filled with wax.

13. An apparatus according to claim 11 wherein said first space is an air space.

14. A reactive armor system for defeating kinetic energy threats to targets including military vehicles, comprising:

means defining a metal housing removably connected to said military vehicle by a plurality of cap screws for ease in mounting and removing said metal housing from said vehicle;

means defining a plurality of layers of first flyplates spaced from each other and lying in spaced parallel planes;

means defining a plurality of first spaced stacks of glass blocks with each said first stack of glass block in vertical aligment with said first flyplates; and means for bonding each said spaced first stack of glass blocks and associated said first flyplates together within separate housing formed from urethane.

15. A method for defeating chemical energy and kinetic weapons to targets such as walls of military vehicles, comprising the steps of:

intercepting the weapon with at least two spaced layers of flyplates embedded in urethane housings;

separating said at least two spaced layers of flyplates by a distance between said at least two spaced layers of flyplates by enclosing a plurality of glass plates between said at least two layers of flyplates; and providing a third layer of spaced flyplates spaced from said first and second layers of flyplates by a distance substantially equal to the distance between said at least two spaced layers of flyplates.

16. A method according to claim 15 and additionally comprising the step of inserting a layer of wax between said at least two spaced layers of flyplates.

17. A method according to claim 15 and additionally comprising the steps of inserting an air space layer between two of said at least two layers of flyplates.

18. A method according to claim 15, wherein said plurality of glass plates forms two spaced layers of glass plates wherein said chemical energy threats and said kinetic energy threats when moving in horizontal paths contact and pass through said at least two spaced layers of flyplates and said two spaced layers of glass plates before contacting a side wall of said military vehicle.

19. A method according to claim 18 wherein said two spaced layers of flyplates and said two spaced layers of glass plates are at an angle of about 70° from an adjacent side wall of said military vehicle thereby causing more damage to the flyplates and less damage to the adjacent side wall of the vehicle.

20. A method according to claim 18 wherein said two spaced layers of flyplates and said two spaced layers of glass plates are at an angle of about 60° from an adjacent side wall of said military vehicle thereby causing further damage to the flyplates and less damage to the side walls of the vehicle.

* * * * *